US010793320B1

(12) United States Patent
Lee

(10) Patent No.: US 10,793,320 B1
(45) Date of Patent: Oct. 6, 2020

(54) DRINKING CUP TAKEOUT BAG

(71) Applicant: YI TING NON-WOVEN CO., LTD., Taoyuan (TW)

(72) Inventor: Kasley Lee, Taoyuan (TW)

(73) Assignee: Yi Ting Non-Woven Co., Ltd., Taoyuan (TW)

( * ) Notice: Subject to any disclaimer, the term of this patent is extended or adjusted under 35 U.S.C. 154(b) by 0 days.

(21) Appl. No.: 16/527,267

(22) Filed: Jul. 31, 2019

(51) Int. Cl.
*B65D 33/08* (2006.01)
*B65D 77/04* (2006.01)

(52) U.S. Cl.
CPC ..... *B65D 33/08* (2013.01); *B65D 77/0406* (2013.01)

(58) Field of Classification Search
CPC ..... B65D 33/08; B65D 77/0406
USPC ..... 383/10
See application file for complete search history.

(56) References Cited

U.S. PATENT DOCUMENTS 4,769,126 A * 9/1988 Roen ..... B65D 33/001 206/554
2018/0162603 A1* 6/2018 Tan ..... B65D 77/12

FOREIGN PATENT DOCUMENTS

JP 2006089101 A * 4/2006
JP 2016098039 A * 5/2016
JP 2017071421 A * 4/2017
JP 2017109765 A * 6/2017

* cited by examiner

*Primary Examiner* — Jes F Pascua
(74) *Attorney, Agent, or Firm* — Rosenberg, Klein & Lee

(57) ABSTRACT

A drinking cup takeout bag has a bag body formed by folding an elongated film into two overlapping film bodies and bonding the film bodies at opposite edges thereof. The bag body has a joined opening, two through openings respectively formed through the film bodies and located near top edges of the film bodies, multiple first bonding portions, multiple second bonding portions, and a third bonding portion. The first bonding portions are arranged along opposite edges of the bag body at spaced intervals. The second bonding portions are arranged from a bottom of the bag body to the first bonding portions. The third bonding portion bonds a middle segment of the film bodies. The drinking cups can be placed in the bag body stably. The first bonding portions are transverse curve lines to increase bonding areas of the bag body and enhance the structural strength of the bag body.

18 Claims, 5 Drawing Sheets

DRINKING CUP TAKEOUT BAG

BACKGROUND OF THE INVENTION

1. Field of the Invention

The present invention relates to a bag, and more particularly to a bag for carrying drinking cups.

2. Description of Related Art

A conventional drinking cup takeout bag substantially has an opening, a containing space, and a handle. The opening is formed in the top of the bag. The containing space is formed in the bag for accommodating cups. The handle is formed on a segment of the bag near the opening for a user to carry the bag easily. In addition, a bottom of the drinking cup takeout bag is formed by directly joining bottom edges of the bag. From a side view, the drinking cup takeout bag is V-shaped.

However, the conventional drinking cup takeout bag does not have a smooth and steady plane formed in the bottom thereof. The bottom of the bag is merely a joined line, as the bottom of the abovementioned V-shaped bag, and the bag does not have features in the containing space to fit with contours or shapes of the drinking cups. When a drinking cup is placed in the drinking cup takeout bag, the drinking cup takeout bag may not fully support the bottom of the drinking cup, and superfluous space will be formed around the drinking cup. The drinking cup is easily inclined, causing spilling and flowing out of drinks in the cup during the carrying.

Some vendors provide a hastag-shaped board in the bottom of the drinking cup takeout bag for supporting the drinking cups. But the board will increase the total weight, size, and other costs for carrying drinking cups. When four drinking cups are placed in the bag, the cups are usually stacked two by two. With the arrangement, the lower drinking cups are stably supported by the board. The upper drinking cups are directly placed on the top covers of the lower drinking cups, but the top covers are usually not planes. This easily causes the upper drinking cups to incline due to shaking and the unstable support at the bottom thereof.

In addition, because the edges of the conventional drinking cup takeout bag are bonded as a single line, the bag has small bonding areas and weak structural strength. The bonding line of the bag will be broken easily upon a slight pulling force, and the broken bag is not reusable.

To overcome the shortcomings, the present invention tends to provide a drinking cup takeout bag to mitigate or obviate the aforementioned problems.

SUMMARY OF THE INVENTION

The main objective of the invention is to provide a drinking cup takeout bag, which has multiple first bonding portions and multiple second bonding portions, the first and second bonding portions being transversely curved bonding lines bonding opposite edges of the bag body. The bag body further has a third bonding portion bonding a middle segment of the bag body. Thus, the drinking cups can be stably placed in the bag, and the bonding strength of the bag body is enhanced.

A drinking cup takeout bag comprises a bag body formed by folding an elongated film into two overlapping film bodies and bonding the film bodies at opposite edges of the film bodies. The bag body has an inner space, a joined opening communicating with the inner space, an annular edge formed around the joined opening, two through openings respectively formed through the film bodies and located near top edges of the film bodies, multiple first bonding portions, multiple second bonding portions, and a third bonding portion.

The first bonding portions bond the opposite edges of the film bodies and are arranged along the opposite edges of the two overlapping film bodies at spaced intervals from the joined opening of the bag body toward a bottom of the bag body to form the inner space between the opposite edges of the two overlapping film bodies. Each first bonding portion is a transversely curved bonding line. The second bonding portions bond the opposite edges of the film bodies and are arranged along the opposite edges of the two overlapping film bodies at spaced intervals from the bottom of the bag body to the first bonding portions. Each second bonding portion is a transversely curved bonding line. The third bonding portion bonds the two overlapping film bodies at a middle segment of the film bodies.

Other objects, advantages and novel features of the invention will become more apparent from the following detailed description when taken in conjunction with the accompanying drawings.

DETAILED DESCRIPTION OF PREFERRED EMBODIMENT

Figure 1:
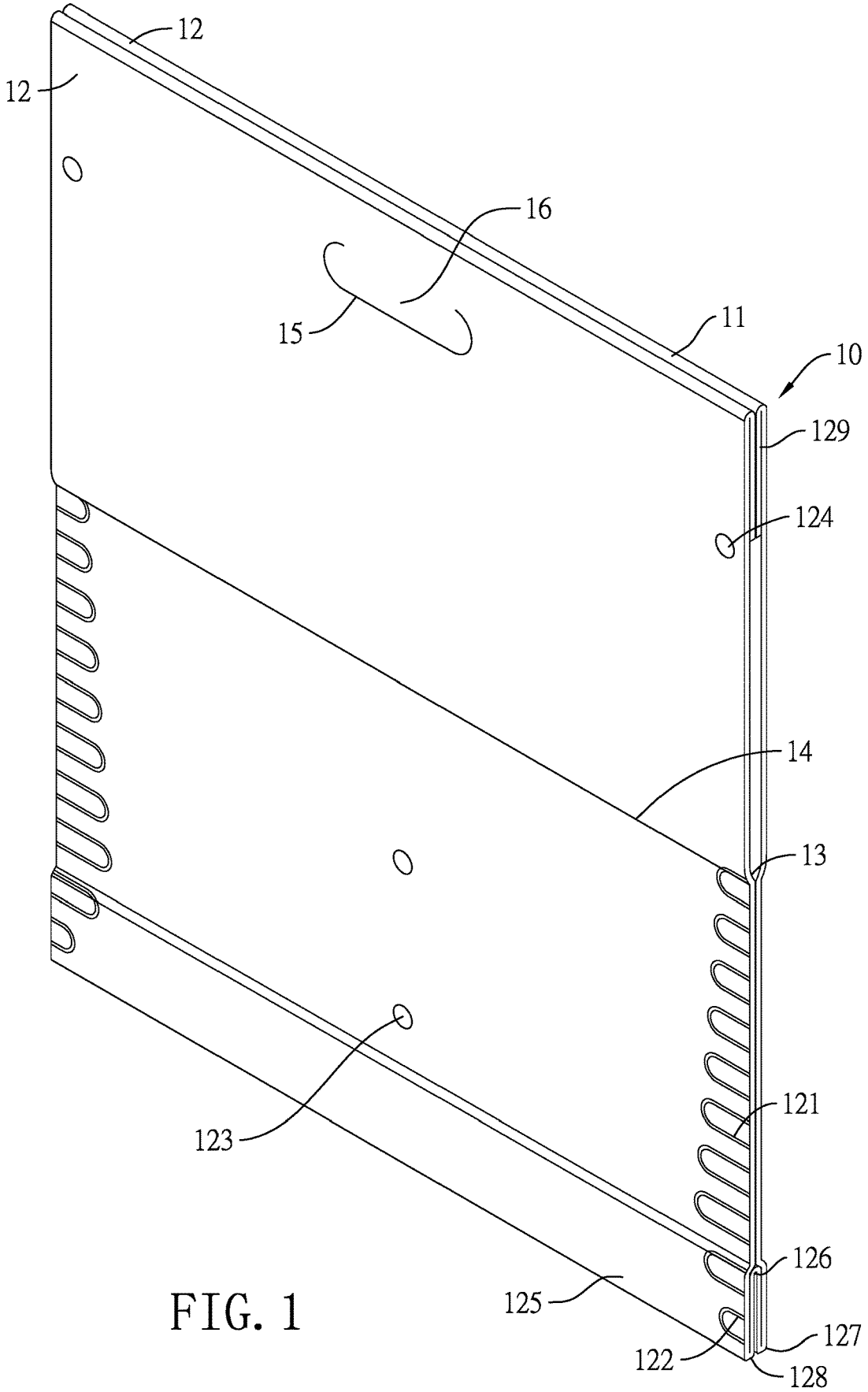
FIG. 1 is a perspective view of a drinking cup takeout bag in accordance with the present invention.
Figure 2:
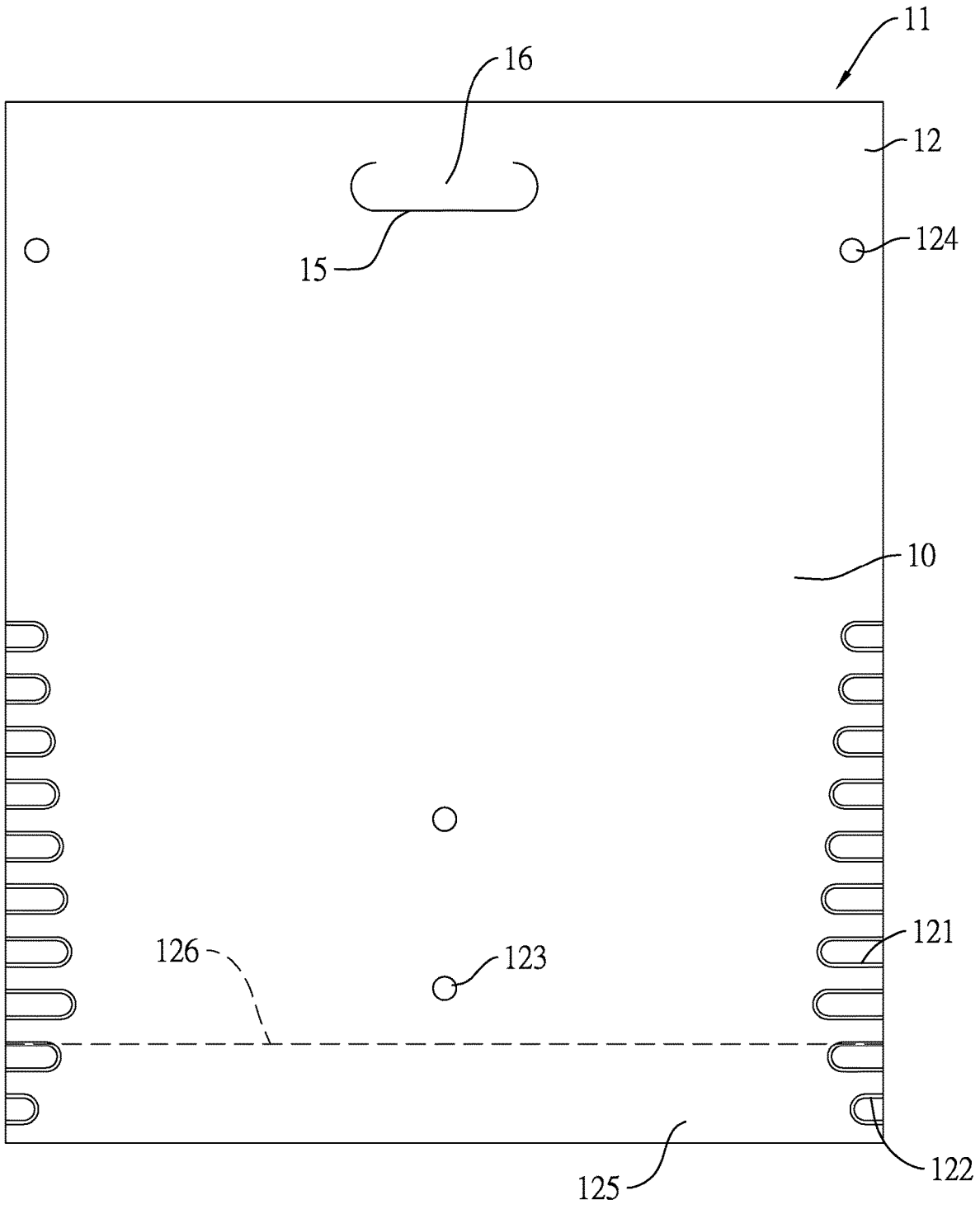
FIG. 2 is a front view of the drinking cup takeout bag in FIG. 1.
Figure 3:
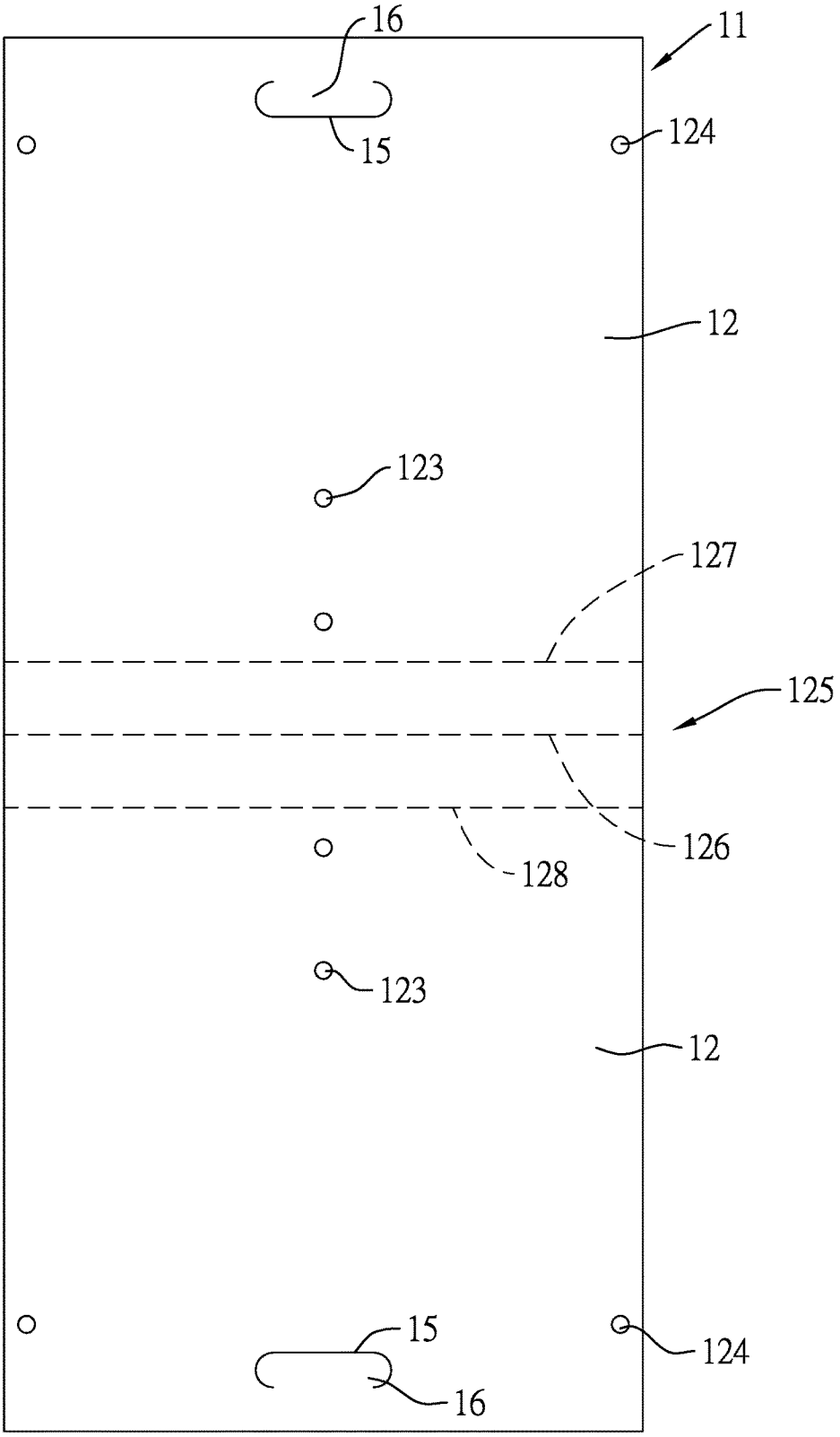
FIG. 3 is a front view of the drinking cup takeout bag in FIG. 1 in an unfolded condition.

With reference to FIGS. 1 to 3, a drinking cup takeout bag in accordance with the present invention has a bag body 10. The bag body 10 is formed by folding an elongated film 11, made of a non-woven fabric material, into two overlapping film bodies 12 and bonding the film bodies 12 at opposite edges of the film bodies 12 by hot compression. The bag body 10 has an inner space, a joined opening 13 communicating with the inner space, and an annular edge 14 formed around the joined opening 13. The bag body 10 has two elongated through openings 15 respectively formed through the film bodies 12 and located near top edges of the film bodies 12. The two through openings 15 are aligned with each other and are adapted for a user to hold the bag body 10. In the embodiment, each through opening 15 has a mask 16 formed by cutting a portion of the bag body 10 in a line. When the bag body 10 is laid flat, the masks 16 may cover the through openings 15. The masks 16 can be pulled up by inserting fingers through the through openings 15 for carrying the bag body 10, but it is not limited thereto. The bag body 10 may have the through openings 15 without the masks 16.

The bag body 10 has multiple first bonding portions 121, multiple second bonding portions 122, a third bonding portion 123, a fourth bonding portion 124, a first folding portion 125, and two second folding portions 129. The first bonding portions 121 bond the opposite edges of the two overlapping film bodies 12 and are arranged along the opposite edges of the two overlapping film bodies 12 at spaced intervals from the joined opening 13 of the bag body 10 toward the bottom of the bag body 10 to form the inner space between the opposite edges of the film bodies 12. Each first bonding portion 121 is a transversely curved bonding line. Preferably, the first bonding portion 121 is transversely U-shaped. The opening of each U-shaped first bonding portion 121 faces to the edge of the bag body 10. The lengths of the first bonding portion 121 gradually increase form the joined opening 13 toward the bottom of the bag body 10. In the front view of the bag body 10, the first bonding portions 121 at each edge of the bag body 10 are formed as a trapezoid (as shown in FIG. 2), but it is not limit thereto. The first bonding portions 121 are for fitting contours of drinking cups.

The second bonding portions 122 bond the opposite edges of the film bodies 12 and are arranged along the opposite edges of the two overlapping film bodies 12 at spaced intervals from the bottom of the bag body 10 to the first bonding portions 121. Each second bonding portion 122 is formed as a transversely curved bonding line. Preferably, the second bonding portion 122 is transversely U-shaped. The opening of each U-shaped second bonding portion 122 faces to the edge of the bag body 10. The lengths of the second bonding portion 122 gradually increase from the bottom toward the corresponding first bonding portion 121 of the bag body 10. In the front view of the bag body 10, the second bonding portions 122 at each edge of the bag body 10 are formed as a trapezoid (as shown in FIG. 2), but it is not limit thereto. The second bonding portions 122 are for fitting contours of drinking cups.

The third bonding portion 123 bonds the two overlapping film bodies 12 at a middle segment thereof. The third bonding portion 123 comprises two bonding spots arranged at a vertical interval. When two drinking cups are placed in the bag body 10, the third bonding portion 123 divides the inner space of the bag body 10 into left and right sections, and supports the inner sides of the two drinking cups that face each other. The edges of left and right sections of the bag body 10 can support a respective drinking cup without wobbling. The arrangement of the third bonding portion 123 is not limited thereto, and can be changed according to different demands to achieve the inner space division and supporting effects.

Figure 4:
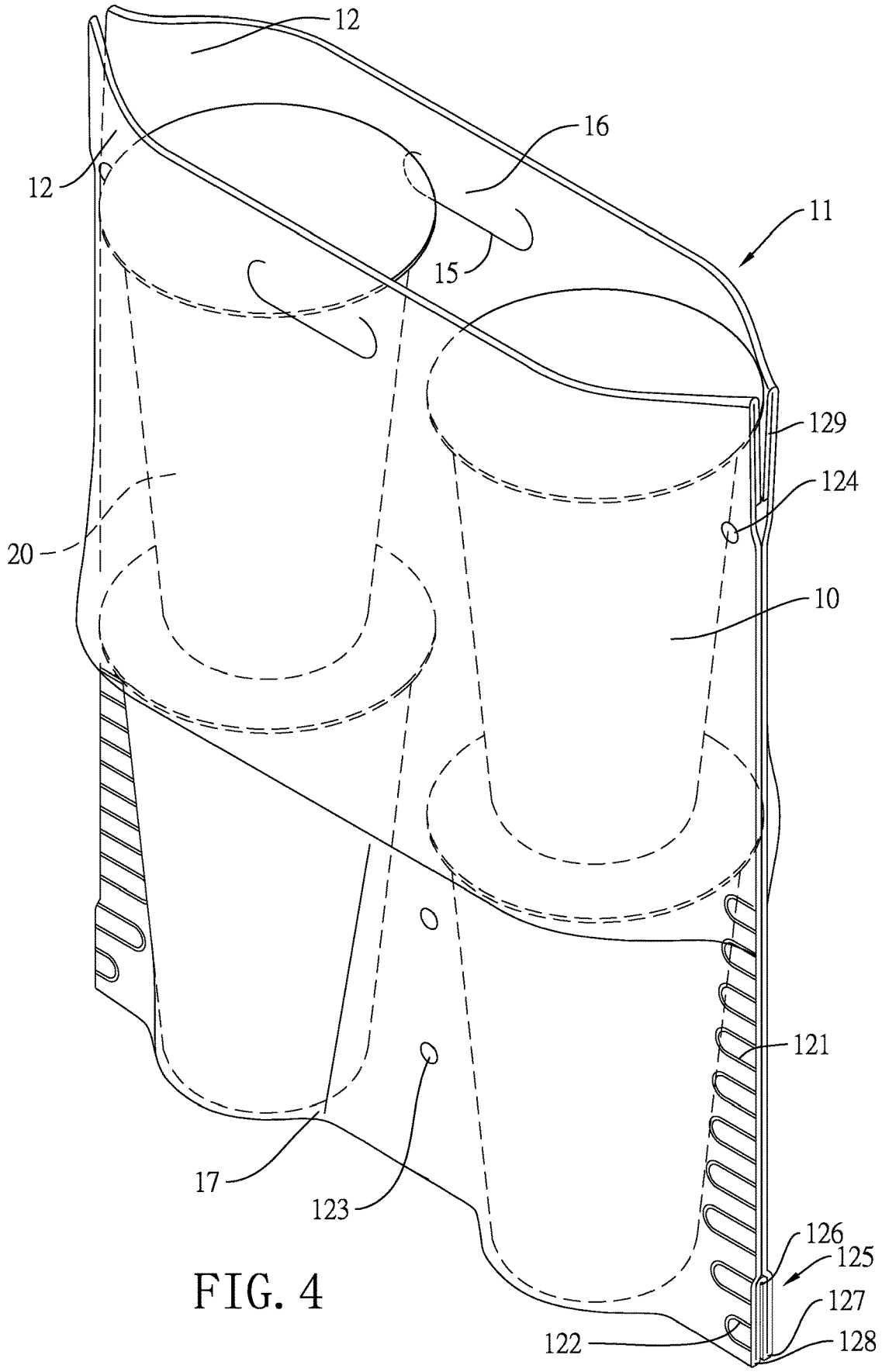
FIG. 4 is an operational perspective view of the drinking cup takeout bag in FIG. 1.

With reference to FIG. 4, the fourth bonding portion 124 bonds the two overlapping film bodies 12 at positions near opposite edges of the film bodies 12 and above the first bonding portions 121. The fourth bonding portion 124 comprises two bonding spots arranged at a horizontal interval. When four drinking cups 20 are two-by-two stacked in the bag body 10 and are respectively placed in left and right sections, the fourth bonding portion 124 is applied for supporting outer sides of the upper drinking cups 20 opposite each other. Thus, the cups are not prone to inclination toward the opposite edges. The arrangement of the fourth bonding portion 124 is not limited thereto, and can be changed according to different demands to achieve the supporting effect.

The first folding portion 125 is formed in the bottoms of the two overlapping film bodies 12, is selectively unfolded to form a bottom plane 17. In the embodiment, the first folding portion 125 is formed by folding a middle segment of the elongated film 11 continuously into four overlapping layers. As shown in FIG. 3, the first folding portion 125 is formed by a middle folding line 126 and two side folding lines 127, 128 are formed in the middle segment of the elongated film 11. The side folding lines 127, 128 are located at opposite sides of the middle folding line 126. After being folded, the side folding lines 127, 128 are located in the bottom edge of the bag body 10. The middle folding line 126 is recessed in and located between the two film bodies 12. The second bonding portions 122 are defined in opposite edges of the first folding portion 125 and bond the edges of the four layers formed by folding the elongated film 11 together to prevent the edges of the first folding portion 125 from unfolding. With reference to FIG. 1, when the bag body 10 is not in use, the first folding portion 125 of the bag body 10 is folded into overlapping layers in a W shape seen from a side view. With reference to FIG. 4, when the bag body 10 is in use, the first folding portion 125 of the bag body 10 is unfolded to form the bottom plane 17. The structure of the first folding portion 125 is not limited thereto, and is applied for achieving the effect of forming the bottom plane 17.

The second folding portions 129 are formed respectively at top edges of the two overlapping film bodies 12. Each of the folding portions 129 is folded and extends from the top edge of the film body 12 toward the bottom of the bag body 10. Preferably, the second folding portions 129 are folded into the inner space of the bag body 10 and are combined with the film bodies 12. The through openings 15 are respectively formed through the second folding portions 129. The thickness of the bag body 10 is increased by the second folding portions 129 to enhance the structural strength around the through openings 15.

Figure 5:
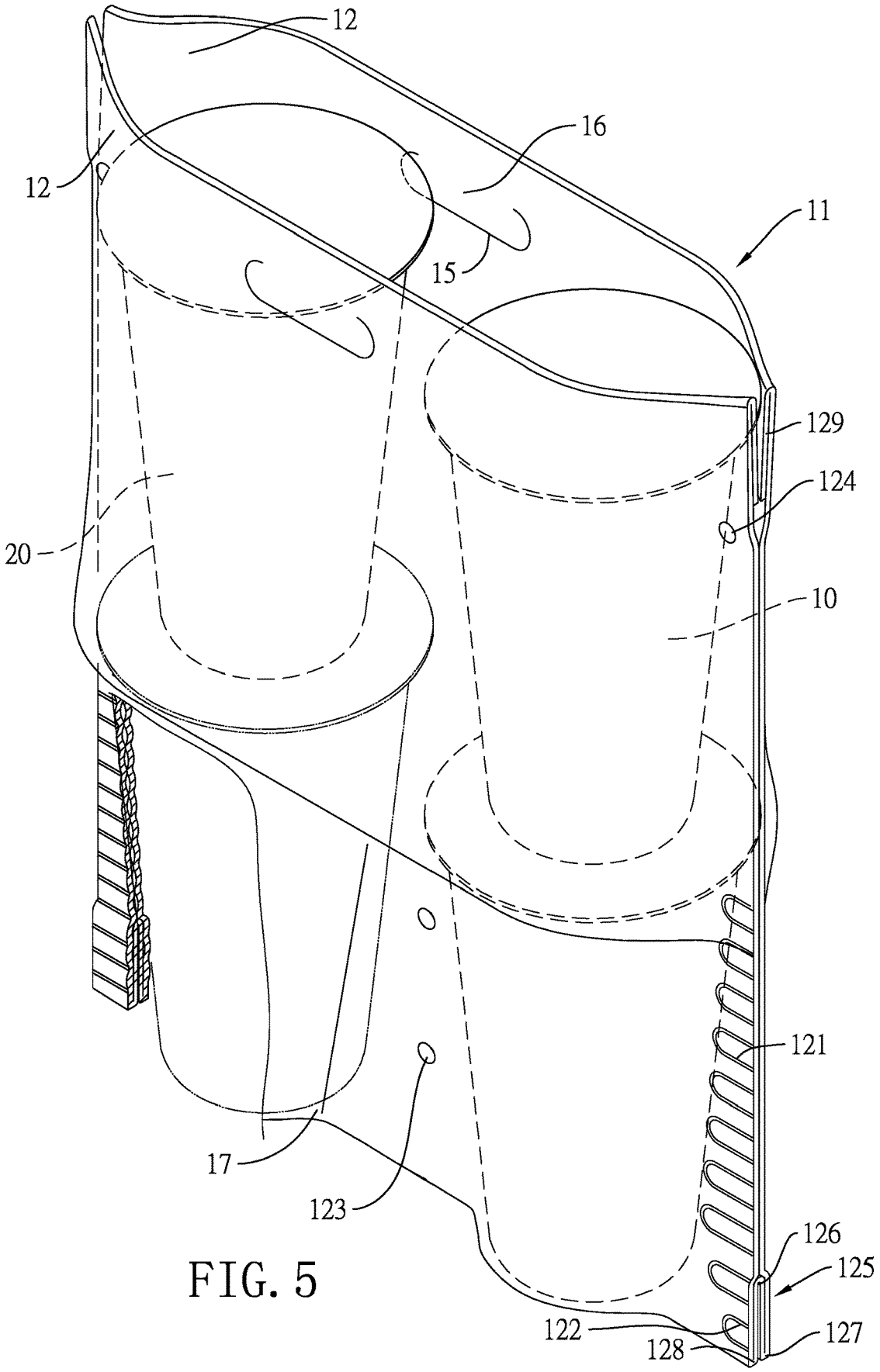
FIG. 5 is an operational perspective view in partial section of the drinking cup takeout bag in FIG. 4.

With reference to FIGS. 4 and 5, when the drinking cup takeout bag in accordance with present invention is in use, the bag body 10 is opened to unfold the first folding portion 125 to form the bottom plane 17. After that, four drinking cups 20 two-by-two stacked are placed into the left and right sections of the bag body 10, and stably stand on the bottom plane 17 formed by the first folding portion 125. The drinking cup takeout bag is stably carried via the through openings 15. After the drinking cups 20 are removed from the bag, the unfolding first folding portion 125 can be folded into an overlapping layered structure along the initial middle folding line 126 and the side folding lines 127, 128. Then, the bag body 10 is pressed flat.

Because the first bonding portions 121 and the second bonding portions 122 are transverse curved bonding lines to bond opposite edges of the bag body 10, the inner space formed between the bonding portions fits contours of the drinking cups 20, and the drinking cups 20 can be placed in the bag body 10 stably. The bonding areas are increased, the bonding strength of the bag body 10 is enhanced, and the bag body 10 is less prone to breaking by external force.

Because of the first folding portion 125, the bottom plane 17 formed from unfolding the first folding portion 125 stably supports the drinking cups 20, the drinking cups 20 will not wobble easily in the bag body 10.

The present invention has the following advantages. The inner space of the bag body 10 is divided into left and right sections and has an outline to fit with outlines of the drinking cups 20. The drinking cups 20 can be stably placed in the left and right sections of the bag body 10. The drinking cups 20 two-by-two stacked and respectively placed in the left and right sections of the bag body 10 will not incline and fall easily. The transversal curved bonding lines increase the bonding areas of the bag body 10 and enhance the structural strength of the bag body 10.

What is claimed is:

1. A drinking cup takeout bag comprising:

a bag body formed by folding an elongated film into two overlapping film bodies and bonding the film bodies at opposite edges of the film bodies, the bag body having an inner space;

a joined opening communicating with the inner space;

an annular edge formed around the joined opening;

two through openings respectively formed through the film bodies and located near top edges of the film bodies;

multiple first bonding portions bonding the opposite edges of the film bodies and arranged along the opposite edges of the two overlapping film bodies at spaced intervals from the joined opening of the bag body toward a bottom of the bag body to form the inner space between the opposite edges of the two overlapping film bodies, and each first bonding portion being a transversely curved bonding line;

multiple second bonding portions bonding the opposite edges of the film bodies and arranged along the opposite edges of the two overlapping film bodies at spaced intervals from the bottom of the bag body to the first bonding portions, and each second bonding portion being a transversely curved bonding line; and a third bonding portion bonding the two overlapping film bodies at a middle segment of the film bodies.

2. The drinking cup takeout bag as claimed in claim 1, wherein lengths of the first bonding portions gradually increase from the joined opening toward the bottom of the bag body.

3. The drinking cup takeout bag as claimed in claim 1, wherein lengths of the second bonding portions gradually increase from the bottom toward a corresponding one of the first bonding portions of the bag body.

4. The drinking cup takeout bag as claimed in claim 2, wherein lengths of the second bonding portions gradually increase from the bottom toward the joined opening of the bag body.

5. The drinking cup takeout bag as claimed in claim 3, wherein the third bonding portion comprises two bonding spots arranged at a vertical interval.

6. The drinking cup takeout bag as claimed in claim 4, wherein the third bonding portion comprises two bonding spots arranged at a vertical interval.

7. The drinking cup takeout bag as claimed in claim 5, wherein the bag body further comprises a fourth bonding portion bonding the two overlapping film bodies at positions near the opposite edges of the film bodies and above the first bonding portions.

8. The drinking cup takeout bag as claimed in claim 6, wherein the bag body further comprises a fourth bonding portion bonding the two overlapping film bodies at positions near the opposite edges of the film bodies and above the first bonding portions.

9. The drinking cup takeout bag as claimed in claim 7, wherein the fourth bonding portion comprises two bonding spots arranged at a horizontal interval.

10. The drinking cup takeout bag as claimed in claim 8, wherein the fourth bonding portion comprises two bonding spots arranged at a horizontal interval.

11. The drinking cup takeout bag as claimed in claim 9, wherein the bag body further comprises a first folding portion, the first folding portion is formed in a bottom of the two overlapping film bodies, the first folding portion is selectively unfolded to form into a bottom plane, and the second bonding portions are defined in the first folding portion.

12. The drinking cup takeout bag as claimed in claim 10, wherein the bag body further comprises a first folding portion, the first folding portion is formed in a bottom of the two overlapping film bodies, the first folding portion is selectively unfolded to form into a bottom plane, and the second bonding portions are defined in the first folding portion.

13. The drinking cup takeout bag as claimed in claim 11, wherein the first bonding portion comprises a middle folding line and two side folding lines formed in a middle segment of the film, the two side folding lines are respectively placed in two opposite sides of the middle folding line; the two side folding lines are defined in a bottom edge of the bag body and the middle folding line is recessed in and defined between the film bodies when the first folding portion is folded.

14. The drinking cup takeout bag as claimed in claim 12, wherein the first bonding portion comprises a middle folding line and two side folding lines formed in a middle segment of the film, the two side folding lines are respectively placed in two opposite sides of the middle folding line; the side folding lines are defined in a bottom edge of the bag body and the middle folding line is recessed in and defined between the film bodies when the first folding portion is folded.

15. The drinking cup takeout bag as claimed in claim 13, wherein the bag body further comprises two second folding portions, the second folding portions are formed respectively at the top edges of the two overlapping film bodies, and each second folding portion extends and is folded downwardly from the film body.

16. The drinking cup takeout bag as claimed in claim 14, wherein the bag body further comprises two second folding portions, the second folding portions are formed respectively at the top edges of the two overlapping film bodies, and each second folding portion extends and is folded downwardly from the film body.

17. The drinking cup takeout bag as claimed in claim 15, wherein the through openings are respectively formed through the second folding portions.

18. The drinking cup takeout bag as claimed in claim 16, wherein the through openings are respectively formed through the second folding portions.

* * * * *